US006113748A

United States Patent [19]

Richardson, Jr.

[11] Patent Number: 6,113,748

[45] Date of Patent: Sep. 5, 2000

[54] NON-FOSSIL FUEL WITHOUT HARMFUL COMBUSTION EFFLUENTS

[76] Inventor: William H. Richardson, Jr., 3035 Hickory Dr., Largo, Fla. 33770

[21] Appl. No.: 09/132,369

[22] Filed: Aug. 11, 1998

[51] Int. Cl.[7] ..... C07C 7/144

[52] U.S. Cl. ..... 204/170; 204/168

[58] Field of Search ..... 95/45, 50, 51, 95/54, 55; 204/170, 168

[56] References Cited

U.S. PATENT DOCUMENTS 3,335,545 8/1967 Robb et al. ..... 95/44
3,651,618 3/1972 Klein et al. ..... 95/44
5,632,803 5/1997 Stoner et al. ..... 95/53

*Primary Examiner*—Kathryn Gorgos
*Assistant Examiner*—Thao Tran
*Attorney, Agent, or Firm*—Charles A. McClure

[57] ABSTRACT

Non-fossil fuel without harmful combustion effluents, the only effluents being water and carbon dioxide. The compositions of which the fuel is made are carbon and water only, which are converted in an underwater electric arc into hydrogen and carbon monoxide as the major and predominant minor gaseous molecular constituents. The fuel also contains pseudo-molecular aggregates, as yet unidentified, of higher weight which are seemingly electromagnetically bound, instead of chemically bound, tentatively called magnecules.

9 Claims, 3 Drawing Sheets

NON-FOSSIL FUEL WITHOUT HARMFUL COMBUSTION EFFLUENTS

TECHNICAL FIELD

This invention relates to an electropyrolytically produced non-fossil fuel, free of harmful particulate and gaseous effluents, and superior to hydrogen in heat output and lower combustion temperature.

BACKGROUND OF THE INVENTION

Internal-combustion engines commonly provide motive power for operating electrical generators, motor vehicles, and many other uses. Most such engines are bad polluters because they operate on fossil fuels, which contain a wide variety of components incapable of being fully combusted together within their brief residence in an engine.

Combustion effluents of fossil fuels, such as coal, petroleum (including diesel oil, kerosene, jet fuel, and gasoline), and even natural gas, contain—in addition to customary carbon dioxide and water—undesirable hydrocarbon fragments and derivatives, often in particulate form, carbon monoxide, and gaseous oxides of nitrogen and/or of sulfur transformable to noxious droplet form (acid rain).

Hydrogen was long-considered an ideal fuel because convertible completely to water via air combustion. See century-old Eldridge U.S. Pat. No. 603,058 for Electrical Retort wherein an electric arc flashed water to steam, then pyrolyzed it and carbon electrodes in a high-pressure reaction vessel, in order to recover hydrogen.

Yet hydrogen is unsatisfactory as an internal-combustion engine fuel, because the high temperature and the rapidity of its combustion foster pre-ignition or flashback, which is greatly harmful to engine operation and structure. Also flashback is conducive to an increase of harmful nitrogen oxides (aptly: "NOx") in the atmosphere.

An instructive reference is *HYDROGEN STORAGE AND UTILIZATION IN TRANSPORTATION VEHICLES—SUMMARY,* United States Department of Energy, Alternative Fuels Utilization Program, Office of Transportation Systems (1988). Despite the intervening decade of research and development, no vehicle running on hydrogen as its main or sole fuel is yet commercial, notwithstanding much experimentation on fuel cell technology, which is fundamentally electrolytic and slow-generating.

Other commercial fuels and their uses, such as acetylene burning in a cutting or welding torch, have similar drawbacks. Acetylene also requires a higher concentration of oxygen than is present in air to enable the desired high temperature and facility of operation.

SUMMARY OF THE INVENTION

A primary object of the present invention is to provide from simple readily available materials a non-self-combustible gas mixture effectively combustible with air without producing noxious effluents.

Another object of this invention is to run internal combustion engines on such fuel gas, as to operate vehicles, as by a mechanical drive or by electricity generated by motor-generators so driven.

A further object of the invention is to operate cutting and welding torches on such fuel gas, as for cutting and welding of metals.

Yet another object is to provide a fuel adapted to burn cooler than hydrogen and to provide more heat energy output than hydrogen.

A still further object is to achieve the aforementioned objects in economical fashion, even including related environmental costs.

In general the objects of the present invention are attained by high-temperature underwater carbon arcing, preferably at or near the ambient temperature and pressure, whereby a non-self-combustible, cleanly combustible gaseous fuel is provided safely and efficiently.

More particularly, the objects of this invention are embodied in a fuel gas rich in readily combustible gaseous hydrogen and carbon monoxide, and containing hitherto unidentified heavier constituents conducive to the desirable combustion characteristics of this fuel.

Other objects of the present invention, together with means and methods for attaining the various objects, will become apparent from the following description and the accompanying diagrams of preferred embodiments presented here by way of example rather than limitation.

To the extent that the description includes commentary bordering perhaps more on theoretical than practical aspects of the invention, readers will understand that such commentary is interpretive, rather than definitive, and so may be superfluous to practical understanding of how to practice the invention and to utilize it to good advantage.

DESCRIPTION OF THE INVENTION

Figure 1:
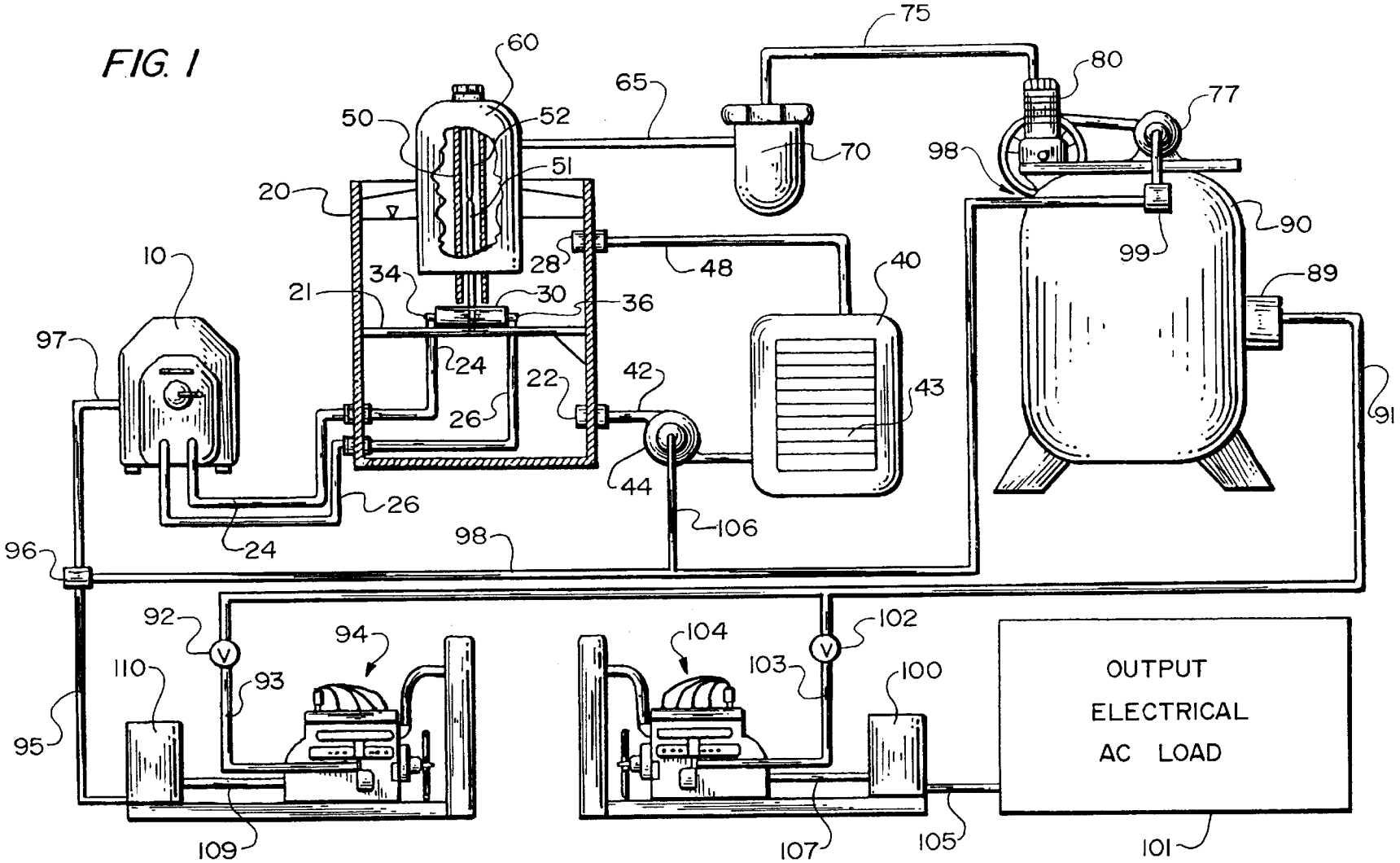
FIG. 1 is a schematized elevation of apparatus adapted to make, to collect, to store, and to use, the fuel gas of this invention.

FIG. 1 shows in schematic elevation apparatus for evolving and collecting a mixture of gases as the fuel gas of this invention. At the left is welder 10 as an exemplified high-current power supply. Pair of electrical leads 24, 26 go to and through the sidewall of reactor 20 and connect at terminals 34, 36 flanking block electrode assembly 30 (detailed in FIG. 2) supported on horizontal partition 21, located at a level intermediate between reactor top and bottom.

Reactor 20 contains water (dashes) to a high level (inverted unshaded triangle) covering not only the electrode assembly but outlet 22 near the bottom to pipeline 42 containing filter/pump 44 and leading to heat exchanger 40 mostly hidden by louvers 43 and on to the near end of return line 48, which extends from the heat exchanger back to the reactor. Rod magazine 50 and concentric gas collection hood 60 extend downward to enter the reactor from above and terminate under water above block electrode assembly 30. First and second rods 51 and 52, aligned upright within the magazine, are centered above the electrode assembly, with the bottom end of the first rod bridging the spaced edges of the respective electrodes (shown later) and with the bottom end of the second rod abutting top end of the first rod.

Gas takeoff line 65 connects the interior of hood 60, above the water line, to filter 70, from which gas collection line 75 connects to compressor 80 on top of, and communicating with, storage tank 90. Tank outlet valve 89 has fuel product supply line 91 connecting the tank through valves 92 and 102 to respective fuel lines 93 and 103 to respective internal combustion engine assemblies 94 and 104. Shaft 109 from engine 94 connects to electrical generator means 110, from which a first set of local leads 95 connect via junction 96 as a secondary electrical source to welder 10, and a further set of leads 98 connects from that junction to reactor water recirculator motor 44 and via junction 99 to motor 77 for compressor 80 located on top of fuel product storage tank 90. A set of leads 100 goes from motor-generator 100 driven via shaft 107 from engine 104 to (block form) Output Electrical AC Load. Not shown in FIG. 1 is a further fuel supply line to a welding or cutting torch indicated in block form in the next view.

Figure 2:
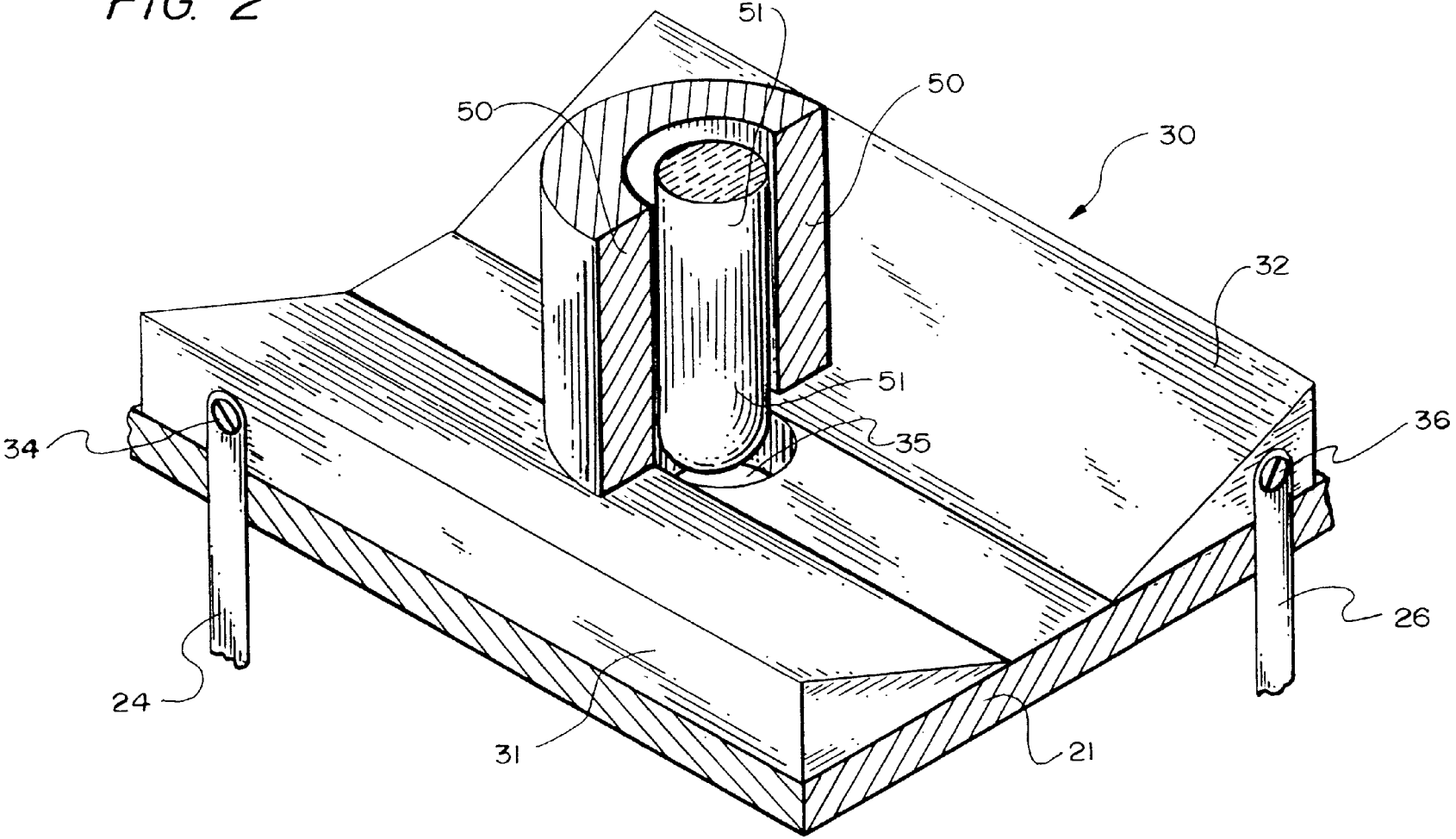
FIG. 2 is a fragmentary perspective view, on an enlarged scale, of electric arcing elements, and vicinity, of the same apparatus.

FIG. 2 shows, in perspective and on an enlarged scale, electrode assembly 30 located on top of partition 21 (cut away along its visible edges) in the FIG. 1 reactor (otherwise not shown here). The partition has central opening 35 between the narrow spaced apart edges of respective wedge-shaped electrodes 31, 32. The lower end of carbon rod 51 (visible where magazine 50 is cut away) is nearing the opening, within which it will rest as the arc is struck across the electrodes and through the rod whenever power is applied across the electrodes at terminals 34, 36 on respective electrical leads 24, 26.

Mention of water is omitted as unnecessary to an understanding of this view, but in brief it will be understood that an electric arc is struck between already submerged electrodes—and part of the rod. The arc heats everything so greatly as to break the water down into its (gaseous) constituents, hydrogen and oxygen, and also to vaporize carbon from the rod and the electrodes, containing carbon. Possible other decomposition is considered further below but is unnecessary to understand of any of the drawing views. The next view will consider the order in which various operating procedural steps occur.

Figure 3:
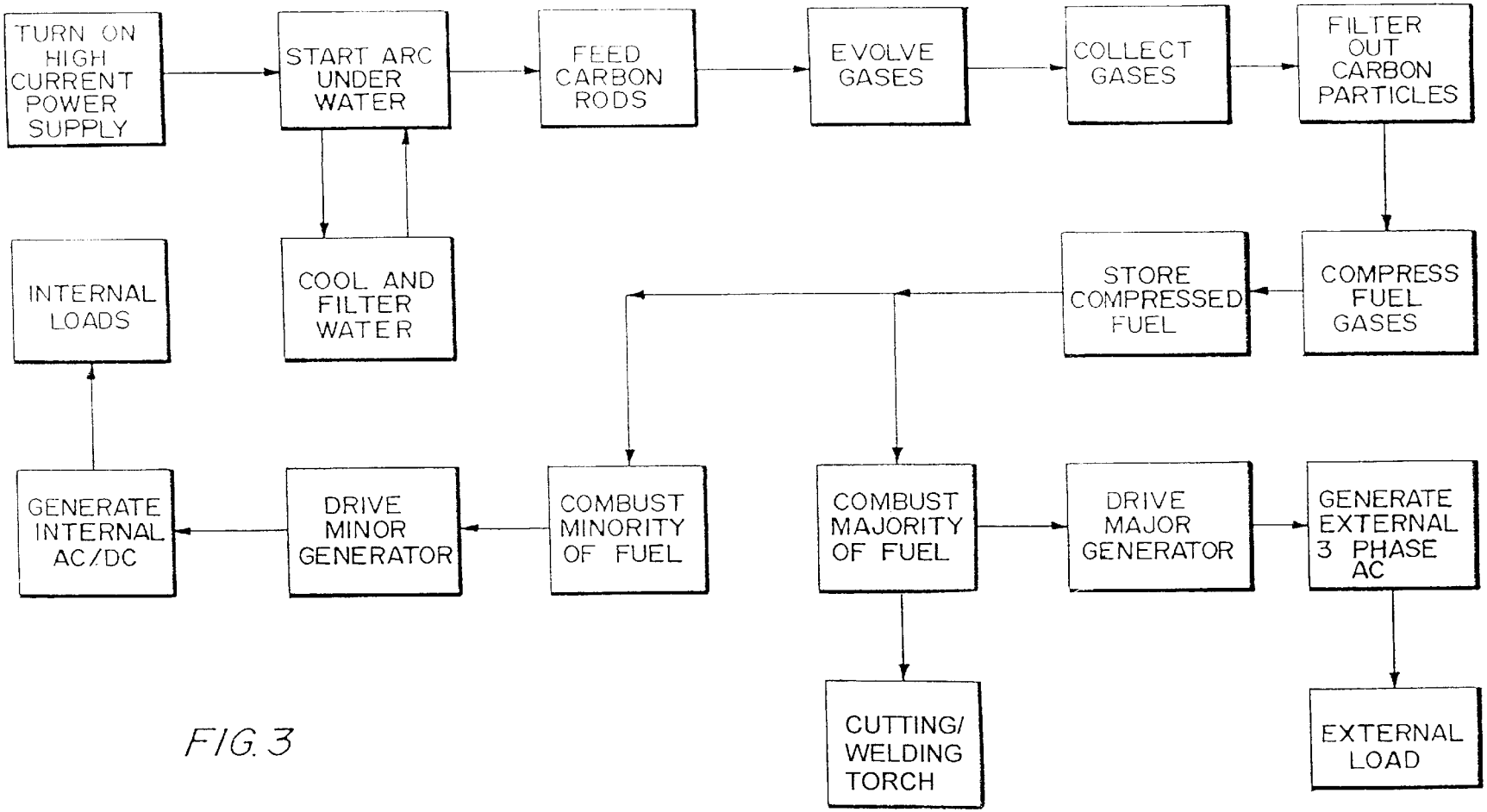
FIG. 3 is a schematic block diagram of the gaseous fuel of this invention, and of various means and methods of its utilization.

FIG. 3 shows, in block form, a flow diagram of steps that take place in the practice of this invention. Sequential steps along the top row include Turn On High Current Power Supply, Start Arc Under Water, Feed Carbon Rods, Evolve Gases, Collect Gases, and Filter Out Carbon Particles, followed by (in second row) Compress Fuel Gases, and then Store Compressed Gases. Spaced apart in the second row is an accessory step, Cool And Filter Water, performed intermittently or continuously, as may be selected, to water conditions as desired, especially at the underwater locus of gas evolution—from which the evolved gases bubble up through the intervening water and into the overlying hood, to be drawn off and stored for use.

From the second row in FIG. 3, the next step is Combust Majority of Fuel, followed (in third row) by Drive Major Generator followed by Generate External 3 Phase AC, and then External Load, which might be anything from a bank of lights or electric tools to an electric car, for example. That series of steps to external uses is paralleled by a similar series of internal steps: Combust Minority of Fuel, Drive Minor Generator, Generate Internal AC/DC, followed by Internal Loads. Also connected to Combust Majority of Fuel is the alternative or even concurrent end use, Cutting/Welding Torch, which is self-explanatory.

How to practice this invention is readily apparent from FIGS. 1 to 3 and the foregoing description. Reference numerals, having been applied hereinabove, are omitted here to aid the descriptive flow.

No unusual materials of construction are needed in apparatus of this invention. The reactor need be only a structurally sound tank, such as steel or other metal, and is preferably grounded. The hood to receive the evolved gases may be separate from or combined with the tank. The magazine to hold and dispense carbon rods also may be made of metal, plastic, or ceramic. The magazine may accommodate any convenient number of rods, preferably loaded at least partly upright, end-to-end or side-by-side and aligned so as to feed down to an exit directly above the desired electrode-bridging location, so as to be fed by gravity, although automatic feed may be adopted if preferred.

Underwater arcing occurs when a sufficient electrical potential (either A.C. or D.C.) of at least a few dozen volts such as used in welding is applied across the block electrodes, preferably graphite, provided with a bridging conductive rod (also carbon) therebetween. Pyrolysis ensues, and some of the highly heated water dissociates, as into its component hydrogen and oxygen; also much carbon vaporizes.

Gas bubbles evolve within the water and, being confined only thereby, rise in the water because of their buoyancy and collect above the water under the hood. The hood's contents are retrieved substantially continuously and then are compressed into the holding tank, as already indicated, for subsequent use as may be desired The water in the reactor tends to get progressively hotter but is kept relatively cool, preferably from ambient temperature to at most about 140° F. (60° C.) by heat-exchange in the temperature-control system, enabling the generation of steam for whatever use and the condensation of potable water from the steam, whether formed from brackish, polluted, or even sea water. Safety is enhanced by working also at ambient pressure, assured by having the water surface open to the atmosphere instead of confined in a high-pressure reactor (as in Eldridge), although other favorable operating conditions may exist.

Both the conductive rod and the electrodes are consumed bit by bit by the electric arc, as is the water, whose level is maintained above the arc by added water or by recirculation of steam condensate. The rods are consumed relatively rapidly and are fed in succession from the magazine above the reactor. The electrodes, being massive by comparison, last much longer but eventually have to be replaced. It is unnecessary to include additional compositions in either the electrodes or the rods, whose purity favors desirably pure effluent.

This fuel gas burns easily and evenly, with adequate access to air (about a half dozen times the fuel volume), and can operate an internal combustion engine without carburetor or injection nozzle. Conversion of gasoline vehicles to this gaseous fuel, however, may be facilitated by use of a gas fuel adapter. Suitable adapters are available from Garretson Equipment Co., Inc., Mt. Pleasant, Iowa. Also note Garretson U.S. Pat. Nos. 3,974,851; 4,375,798; 4,829,957.

The effluent from combustion of the fuel of this invention is substantially entirely carbon dioxide gas and water vapor, as shown by analyses of effluent from lawnmower and automobile engines fueled with it. Hydrocarbon fragments in any form are conspicuous by their absence, as are all particulates, presumably because of the facility of complete combustion of the very pure components of the fuel gas. A slight possibility of hydrocarbon contamination may result from the currently used petroleum-based lubricants, or from freeing carbonized deposits of formerly used lubricants and fuels, as in old engines.

Indeed, an internal-combustion engine running on this fuel can be located in an occupied room without harming the occupants, as its operation normally reduces pre-existing concentration of the ordinary pollutants in the ambient atmosphere (the combustion air source), so such engine operation cleans the air rather than contaminating it. Of course, continued operation would convert oxygen progressively into carbon dioxide, which—though harmless—will not support human life.

The distinction between the effluent of an internal-combustion engine on the fuel gas of this invention and the noxious fumes from its conventional operation on gasoline has to be seen—and smelled—to be believed and enjoyed. The pre-combustion odor of the fuel of this invention is not readily identifiable (sweet onion?) and is so slight as to evidence minimal, if any, organic content. It is fresh air by comparison with gasoline, much less a gasoline engine exhaust.

Effluent analyses by competent objective analysts have confirmed the environmental merits of this fuel. Carbon monoxide is completely absent from the effluent, as are unburned particulates, whether of carbon or hydrocarbons. Oxides of nitrogen, common in combustion products of gases from fossil fuels or hydrogen alone, are minimal.

The fuel of this invention has practical operational advantages over hydrogen. For example, the open-air combustion temperature of hydrogen at 655° C. is substantially higher than the 619° C. of the fuel of this invention under like conditions. Engines also run cooler on it than on hydrogen, thereby reducing Nox production. Yet where a higher operating temperature is desirable, as in cutting cold-rolled steel, the fuel of this invention showed 1462° C. vs. 1446° C. for both hydrogen and acetylene. The available heat content of this fuel has been confirmed as 1243 (BTU/cu.ft.) at a density of 0.0562 (lb./cu.ft) vs. 300 at a density of 0.005 for hydrogen, and 1500 at a density of 0.0678 for acetylene.

The fuel gas of this invention is slower overall than its identified component aggregated constituent compositions to escape through a semi-permeable membrane. Comparative testing in balloons made of elastomeric material, such as are filled with air or perhaps helium for entertainment, confirmed this remarkable property. A hydrogen-filled balloon fully deflates (equalizes inside-to-outside pressure differential) by diffusion of hydrogen gas molecules outward through such balloon wall in a matter of several hours. A balloon will soar up and away when filled with this fuel but will not lift off the next day after being filled.

Identical balloons pressurized (to the same extent) with air, acetylene, carbon oxide (monoxide and/or dioxide) or mixtures thereof deflate likewise in several days. In contrast, identical balloons pressurized to the same extent with the fuel gas of this invention deflated only about halfway in a couple weeks, and retained inside-to-outside pressure differential for several months or longer. These experiments may have to be done to be believed, but they have been done repeatedly, with like outcomes each time.

In other words, the time for diffusion of the fuel gas of this invention through such a common semi-permeable membrane is at least about an order of magnitude (ten times) as long as the corresponding time for the other mentioned gases (except hydrogen) and about two to three orders of magnitude (a hundred to a thousand times) as long as hydrogen. The diffusion rates vary inversely to the times, of course. Observable difficulty in passage through (and depositing in) small lines of analytic and other apparatus has tended to corroborate presence of something larger than expected in this remarkable fuel.

Early physical-chemical analyses of the fuel of this invention failed to account for its apparent leak-resistant property. Thus, speculation about possible presence of gaseous polymers, fullerenes, etc. has ensued. Early spectrographic analyses did not consider any weight greater than about fifty to be significant enough to report. However, one did so, and reported many higher significant weights, which were dismissed, such as being from "noise" or contamination. However, two more recent spectroscopic checks by other experts, have confirmed substantial readings at low, medium, and high portions of the range from 100 to 200, at low and medium to high figures in the range from 200 to 300, and at low to medium figures in the range from 300 to 400—all expressly stated as conforming to no known substance.

A world-renowned physicist has personally observed/supervised the last two such analyses and is convinced that the fuel contains as yet unidentified materials, electromagnetically bonded, as distinct from chemical bonding, whereupon it seems reasonable to call slow-diffusing portion(s) of the fuel "magnecules"—emphasizing their magnetic character over their size or "magnacules"—by analogy with "molecules" although their true nature remains quite mysterious. Such magnecules may be undergoing continuing changes in composition.

To guard against contamination of gas samples for analysis, only distilled water was used, and the electrodes and rods were confirmed as extremely closely to 100% pure carbon. In practice, it does not appear that contamination of the water carries over to the resulting fuel. Moreover, the water is effectively distilled in the process. Of course, contamination with hydrocarbons should be avoided, as they might be gasified and be incompletely combusted, and pollute the air.

The conventional portions of the prior spectrographic analyses may have led to an overestimate of the concentrations of identified gases, especially hydrogen as the major gaseous component, and carbon monoxide as the most prominent of the minor gaseous components. At present their concentrations appear to be closer to one another than believed before, as well as substantially reduced to allow for the high-weight magnecules. Accordingly, a revised estimate places the hydrogen content from about three-eighths to about a half, and the carbon monoxide content from about one-fourth to about three-eighths.

The operation of the described apparatus at ambient pressure and temperature is preferred for reasons of safety and now also because of its possible contribution to the uniqueness of the fuel produced. Higher pressure and/or temperature might produce more, or even less, beneficial effects. The present molecular and/or magnecular content produce(s) such fine performance as to discourage any hasty changes.

The precise molecular and/or magnecular distribution of the fuel may even be less important than its limitation to carbon, hydrogen, and oxygen—and their ready and complete air-combustion to only water and carbon dioxide. Any contribution of magnecules or other as yet unidentified aggregations of matter to the rapidity, smoothness, completeness of that conversion is a bonus to those persons who receive the advantages and benefits of this invention in its actual practice.

What is claimed is:

1. Method of fractionating a gaseous fuel from underwater electrical carbon arcing by diffusion through a semi-permeable membrane, into a first fraction within the first several hours, a second fraction within the next several days, and a final fraction within the next several months.

2. Method according to claim 1, wherein the first fraction comprises mainly molecular hydrogen, wherein the second fraction comprises mainly molecular carbon monoxide, and wherein the third fraction comprises larger gaseous aggregations of one or more of the starting elements of carbon, hydrogen, and oxygen.

3. Method according to claim 1, plus preliminary steps of (a) evolving the fuel gas from an underwater electric arc between submerged electrodes provided with solid carbon; and (b) including collecting bubbles of such fuel gas evolving in the arc vicinity and rising to the surface of the surrounding water.

4. Method according to claim 3, including also the step of (c) continually maintaining an upper surface of the water in which the electrodes are submerged open to the ambient atmosphere.

5. Method of fractionating a gaseous fuel, prepared from molecules consisting essentially of the elements carbon, hydrogen, and oxygen, from underwater electrical arcing into three successive fractions via differential diffusion, as through a semi-permeable membrane, comprising the successive steps of diffusing a first fraction therethrough in several hours, and then diffusing a second fraction therethrough in the next several days, and then diffusing a final fraction therethrough in the next several months.

6. Method according to claim 5, wherein the first fraction comprises predominantly molecular hydrogen.

7. Method according to claim 5, wherein the second fraction comprises predominantly molecular carbon monoxide.

8. Method according to claim 5, wherein the third fraction comprises predominantly aggregates, however bonded.

9. Method according to claim 8, wherein the aggregates are magnecules, each consisting essentially of one or more of the elements: hydrogen, carbon, oxygen.

* * * * *

US006113748C1

(12) REEXAMINATION CERTIFICATE (4796th)

United States Patent

Richardson, Jr.

(10) Number: US 6,113,748 C1

(45) Certificate Issued: Jun. 10, 2003

(54) NON-FOSSIL FUEL WITHOUT HARMFUL COMBUSTION EFFLUENTS

(75) Inventor: William H. Richardson, Jr., 3035 Hickory Dr., Largo, FL (US) 33770

(73) Assignee: William H. Richardson, Jr., Largo, FL (US)

Reexamination Request:
No. 90/006,125, Oct. 9, 2001

Reexamination Certificate for:

| | |
|---|---|
| Patent No.: | **6,113,748** |
| Issued: | **Sep. 5, 2000** |
| Appl. No.: | **09/132,369** |
| Filed: | **Aug. 11, 1998** |

(51) Int. Cl.[7] ..... C07C 7/144

(52) U.S. Cl. ..... 204/170; 204/168

(58) Field of Search ..... 204/164, 168, 204/170; 95/45, 50, 51, 54, 55; 96/4

(56) References Cited

U.S. PATENT DOCUMENTS 366,081 A * 7/1887 Edgerton ..... 96/4
603,058 A * 4/1898 Eldridge et al. ..... 204/164
3,114,610 A 12/1963 Gafford et al.
3,246,450 A * 4/1966 Stern et al. ..... 95/55
3,335,545 A 8/1967 Robb et al.
3,651,618 A 3/1972 Klein et al.
5,632,803 A 5/1997 Stoner et al.
6,113,748 A 9/2000 Richardson, Jr.

* cited by examiner

*Primary Examiner*—Aron S. Phasge

(57) ABSTRACT

Non-fossil fuel without harmful combustion effluents, the only effluents being water and carbon dioxide. The compositions of which the fuel is made are carbon and water only, which are converted in an underwater electric arc into hydrogen and carbon monoxide as the major and predominant minor gaseous molecular constituents. The fuel also contains pseudo-molecular aggregates, as yet unidentified, of higher weight which are seemingly electromagnetically bound, instead of chemically bound, tentatively called magnecules.

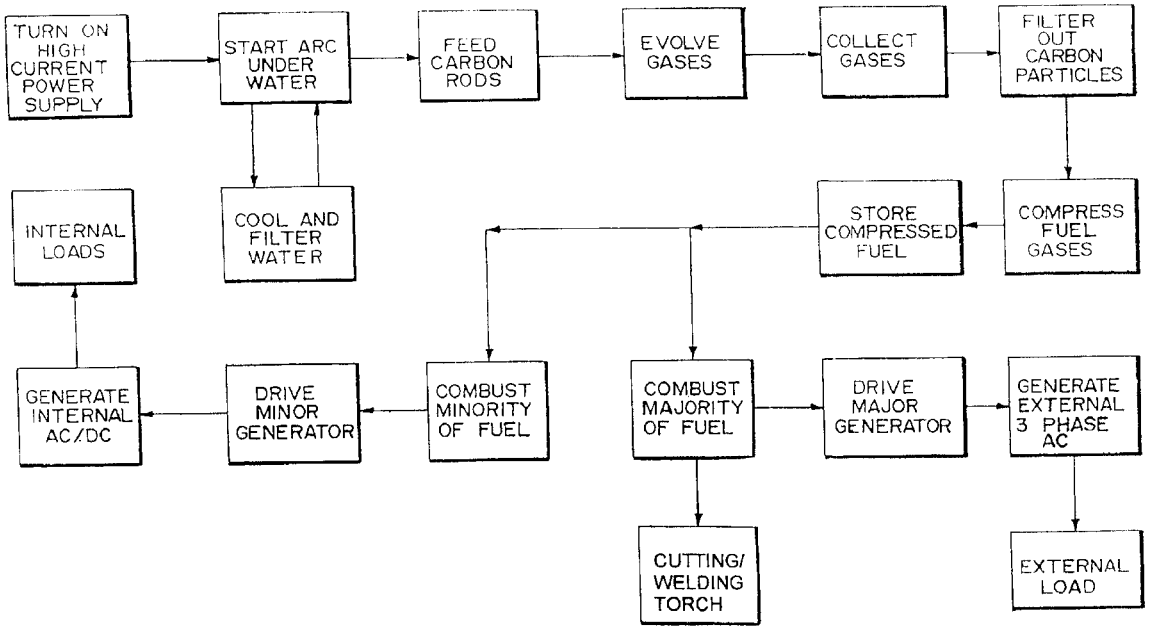

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–9 are cancelled.

* * * * *